US006168443B1

(12) United States Patent
Mullen, Jr. et al.

(10) Patent No.: US 6,168,443 B1
(45) Date of Patent: Jan. 2, 2001

(54) TWO CONDUCTOR BRIDGE

(75) Inventors: Thomas M. Mullen, Jr., Dunellen; William J. Coyle, Jr., Seaside Park, both of NJ (US)

(73) Assignee: Heyco Products, Inc., Toms River, NJ (US)

( * ) Notice: Under 35 U.S.C. 154(b), the term of this patent shall be extended for 0 days.

(21) Appl. No.: 09/314,413

(22) Filed: May 18, 1999

Related U.S. Application Data

(60) Provisional application No. 60/089,075, filed on Jun. 12, 1998.

(51) Int. Cl.[7] ..... H01R 19/08
(52) U.S. Cl. ..... 439/106; 439/606
(58) Field of Search ..... 439/106, 695, 439/606, 736

(56) References Cited

U.S. PATENT DOCUMENTS 4,718,865 * 1/1988 Cordeiro ..... 439/695
4,790,776 * 12/1988 Iijima ..... 439/695
5,411,403 * 5/1995 Blanche ..... 439/106
5,603,638 * 2/1997 Brown et al. ..... 439/106
5,662,484 9/1997 Blanche ..... 439/106

* cited by examiner

*Primary Examiner*—Gary F. Paumen
(74) *Attorney, Agent, or Firm*—Selitto & Associates, P.C

(57) ABSTRACT

A conductor bridge for holding a plurality of electrically conductive elements includes a monolithic body formed from an electrically non-conductive material. Retainer means are provided for retaining the electrically conductive elements in the body such that they are electrically insulated relative to each other. The retainer means has an open position, in which the conductor elements can be placed in the retainer means, and a closed position, in which the conductor elements can be held in place within the body.

21 Claims, 3 Drawing Sheets

TWO CONDUCTOR BRIDGE

CROSS REFERENCE TO RELATED APPLICATIONS

This is a §111(a) application relating to U.S. application Ser. No. 60/089,075 filed Jun. 12,1998.

FIELD OF THE INVENTION

The present invention relates to electric plug conductor bridges, and, more particularly, to a monolithically molded two conductor bridge that is incorporated into an overmolded plug assembly.

BACKGROUND OF THE INVENTION

Previous conductor bridges (e.g., U.S. Pat. No. 5,411,403) have been of a non-integral, multiple piece design. The difficulty with this type of bridge lies in its use of separate pieces to form the bridge; the pieces are not securely attached together until the entire bridge is thermowelded, a step which is not performed until after wires have been attached to the power blades, thereby increasing the potential for misaligned blades.

Another existing method of manufacturing electrical plugs is to place the power blades into a plug-shaped mold, and then infuse plastic to fill the mold around the blades. This method involves a high risk of the blades and the ground pin being deflected off-center by the plastic as it is infused into the mold, which could lead to misaligned blades and a non-functional plug.

SUMMARY OF THE INVENTION

The present invention is a monolithically molded two conductor bridge, made of a plastic type having a higher melting point than PVC; for example, NYLON 66. The bridge is designed such that the power blades are inserted into open-ended slots. The open end of each slot is then closed by bending a retainer along a living hinge and locking the retainer in a closed position, thereby securing the power blades in the slots. The retainer is locked by use of a locking tab on the central portion of the bridge and a corresponding catch on the retainer.

The central portion and the retainers are provided with interdigitating teeth, which mate when the retainer is locked into position. The interdigitating teeth cooperate to prevent lateral movement of the retainer, providing better strain relief action for the entire bridge, and allowing the bridge to withstand higher stresses without breaking or opening. The two conductor bridge of the present invention may be overmolded into a plug in a conventional manner.

The present invention is advantageous over the prior art in that the design of the slots minimizes potential power blade misalignment upon the loading of the blades, even when used with various types of load bars. The use of the slots also allows for different NEMA blade configurations (i.e., 2-15P, 5-15P, 7-15P, 2-20P, or 2-30P), other than the NEMA 1-15P configuration as illustrated herein, to be assembled using the same basic bridge design.

BRIEF DESCRIPTION OF THE DRAWINGS

For a better understanding of the present invention, reference is made to the following detailed description of an exemplary embodiment considered in conjunction with the accompanying drawings, in which.

DETAILED DESCRIPTION OF THE DRAWINGS

Figure 1:
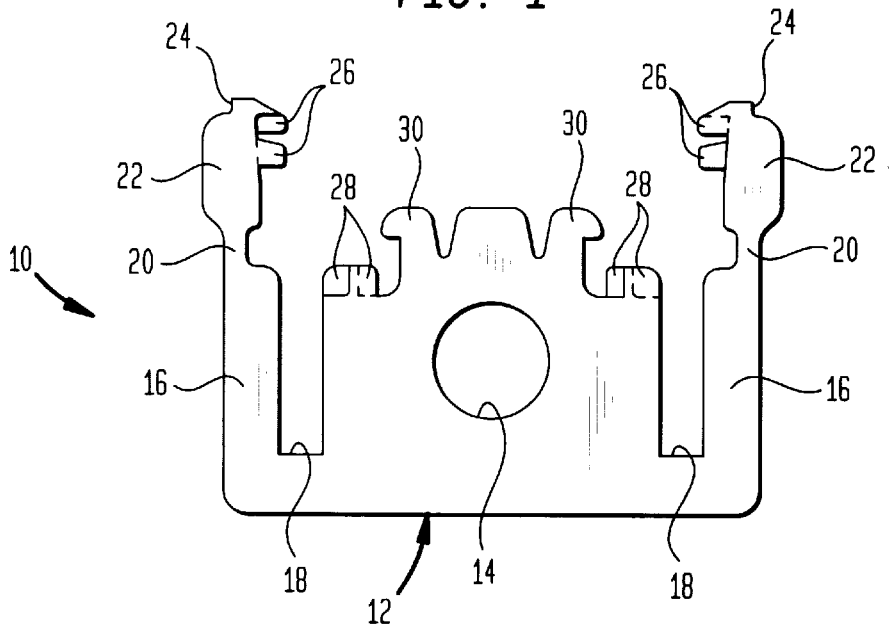
FIG. 1 is a front view of a two conductor bridge constructed in accordance with the present invention with the retainers in the open position.

Referring to FIG. 1, a two conductor bridge 10 has a central portion 12, with a centrally located overmold bore 14, which is provided to vent excess plastic that may overflow during the molding process. At each side of the central portion 12 is an integrally molded arm 16, defining a slot 18 formed between the arm 16 and the central portion 12. A living hinge 20 connects a retainer 22 to each arm 16. A catch 24 is located at the end of the retainer 22, and two staggered teeth 26 extend from the retainer 22, toward the central portion 12. A pair of mating staggered teeth 28 extend upwardly from the central portion 12, adjacent the top of the slot 18. A locking tab 30 is positioned on the central portion 12, slightly above the teeth 28 and closer to the center line of the central portion 12 than the teeth 28.

Figure 2:
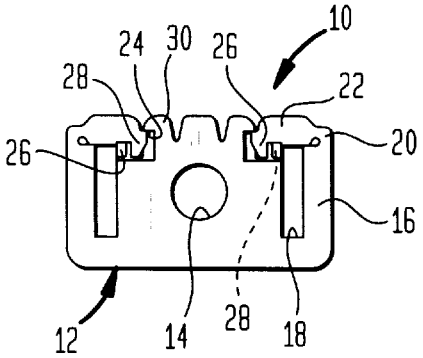
FIG. 2 is a front view of the two conductor bridge shown in FIG. 1, with the retainers in the closed position.
Figure 3:
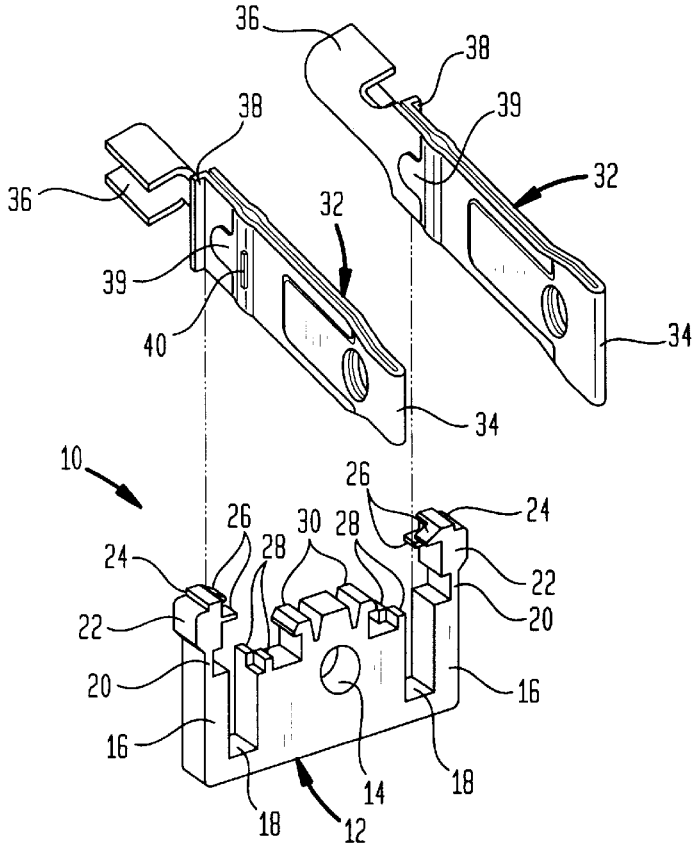
FIG. 3 is an exploded perspective view of the two conductor bridge shown in FIG. 1, with the power blades shown in position above the two conductor bridge.

Now referring to FIGS. 2 and 3, a pair of power blades 32 may be inserted into the bridge 10 by load bars, which place the blades 32 into the slots 18. The retainers 22 are then folded inward toward the central portion 12 along the living hinges 20, with the catches 24 locking underneath the locking tabs 30, thereby securing the blades 32 in the slots 18. When the retainers 22 are locked down, the interdigitating teeth 26, 28 interlock, thereby preventing lateral movement of the retainers 22 in a direction parallel to the pivot axis of the living hinges 20. The use of the teeth 26, 28 and the locking tabs 30 and catches 24 secure the retainers 22 in place and provide better strain relief action to the bridge 10, allowing greater stresses to be placed on the bridge 10 without the retainers 22 opening, without the blades 32 becoming loose within the bridge 10, or without the bridge 10 breaking.

Figure 4:
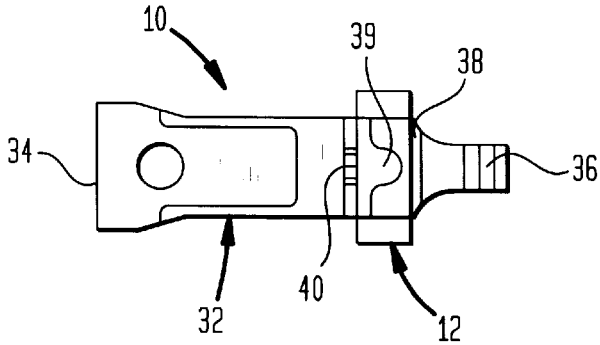
FIG. 4 is a side view of the two conductor bridge shown in FIG. 1, with the power blades inserted and the retainers in the closed position.
Figure 5:
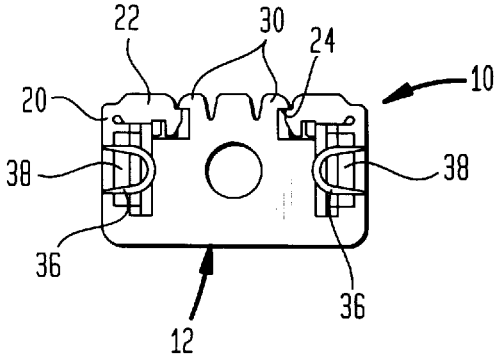
FIG. 5 is a rear view of the two conductor bridge shown in FIG. 4.

As shown in FIGS. 3–5, each power blade 32 has a tip 34 at one end, and an outwardly facing C-shaped wire crimp 36 at an opposite end. Each blade 32 also has an outwardly facing hook 38 located near the wire crimp 36 and a pad 39 with a bump 40 located towards the tip 34, away from the hook 38. The hook 38 and the bump 40 are used to align the blade 32 within the slot 18 when inserted by the load bar. The pad 39 is used to tightly hold the blade 32 in the slot 18 by adding thickness to that portion of the blade 32. The combination of the hook 38, the pad 39, and the bump 40 also prevent the blade 32 from sliding out of the slot 18 once the retainers 22 have been locked in position. Once the blades 32 have been inserted into the slots 18, and the retainers 22 have been locked in position, wires (not shown) can be attached to the blades 32 at the wire crimps 36.

Figure 6:
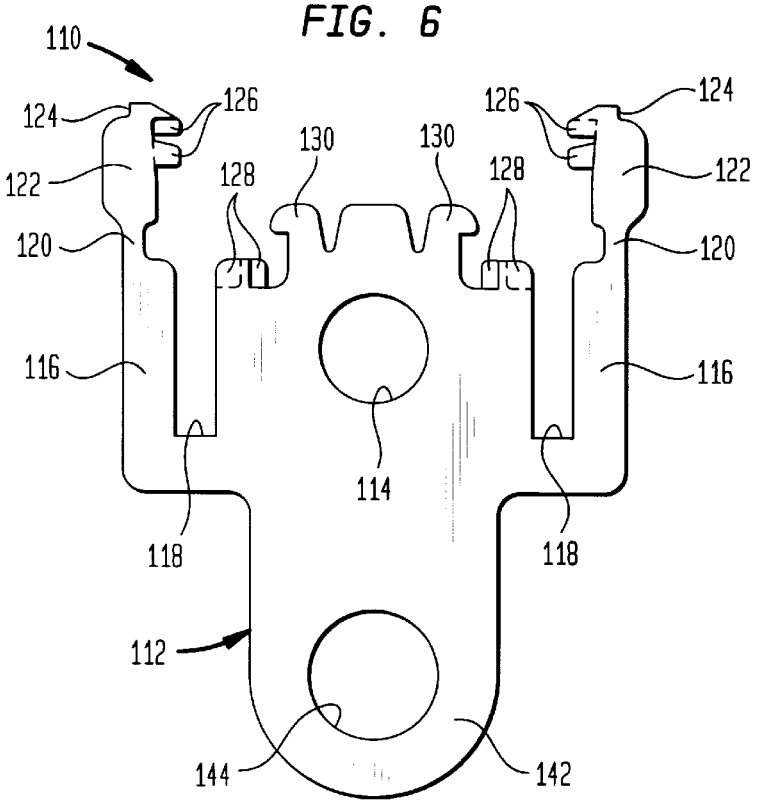
FIG. 6 is a front view of an alternate embodiment constructed in accordance with the present invention, a three conductor bridge.
Figure 7:
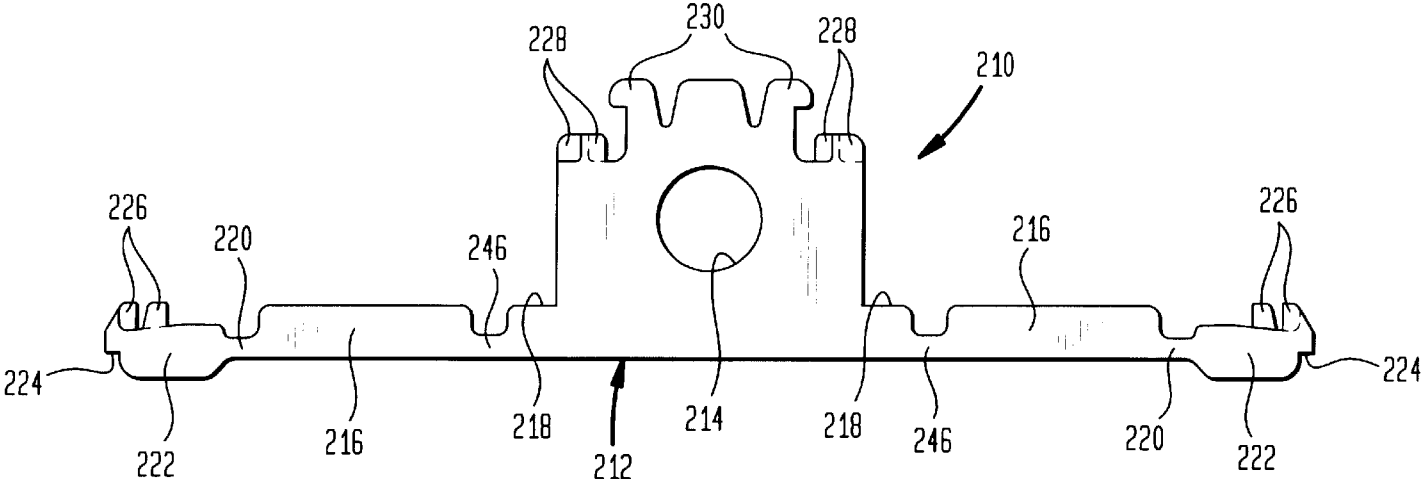
FIG. 7 is a front view of a second alternate embodiment constructed in accordance with the present invention, a two conductor bridge having a second hinge at the base of each arm.
Figure 8:
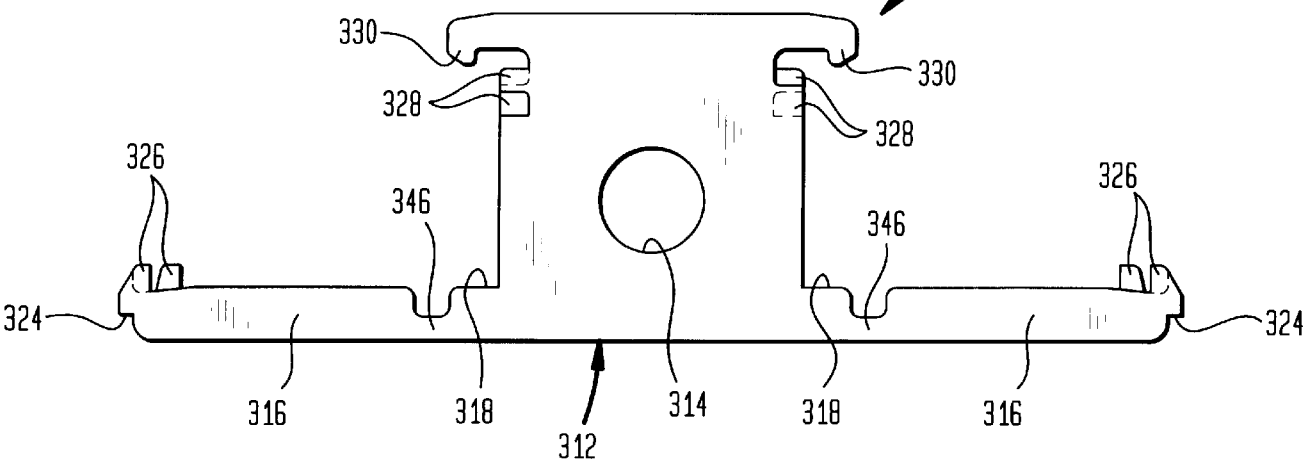
FIG. 8 is a front view of a third alternate embodiment constructed in accordance with the present invention, a two conductor bridge having side-opening retainers.

Three other exemplary embodiments of a conductor bridge constructed in accordance with the present invention are shown in FIGS. 6–8. Elements illustrated in FIGS. 6–8 which correspond to the elements described above with respect to FIGS. 1–5 have been designated by corresponding reference numerals increased by one hundred, two hundred, and three hundred, respectively. The embodiments of FIGS. 6–8 are designed for use in the same manner as the embodiment of FIGS. 1–5 unless otherwise stated.

FIG. 6 shows a three conductor bridge 110 having a central portion 112, including an integrally molded ground pin extension 142. A ground pin bore 144 is located towards the lower end of the ground pin extension 142. When assembled, a ground pin (not shown) is pushed through the ground pin bore 144 and into position in the three conductor bridge 110.

FIG. 7 shows a two conductor bridge 210 having a central portion 212. A living hinge 246 is molded on each side of the central portion 212, and is connected to an arm 216. The arms 216 are bent towards the central portion 212 at the living hinge 246, thereby forming a pair of open-ended slots 218. A pair of power blades (not shown) is then inserted into the slots 218 by a conventional load bar. A retainer 222 closes each slot 218 in the same manner as described in connection with FIGS. 1–5. Alternatively, the power blades can be held in place by a non-conventional load bar while the arms 216 are bent towards the central portion 212 at the living hinges 246, thereby forming the slots 218 around the already positioned power blades.

As shown in FIG. 8, a two conductor bridge 310 has a central portion 312, with a living hinge 346 molded onto each side thereof. An arm 316 is connected to each of the living hinges 346. Each arm 316 has a catch 324 and two staggered teeth 326 at an end opposite the living hinge 346. A pair of mating staggered teeth 328 extend outwardly from the central portion 312. An outwardly facing locking tab 330 is positioned on the central portion 312, slightly above the teeth 328.

A pair of power blades (not shown) is held in position by a non-conventional load bar while the arms 316 are bent toward the central portion 312 at the living hinges 346, thereby forming a pair of slots 318 around the power blades. The catches 324 lock inside the locking tabs 330, thereby securing the power blades in the slots 318. When the arms 316 are locked into position, the interdigitating teeth 326, 328 interlock, thereby preventing lateral movement of the arms 316 in a direction parallel to the pivot axis of the living hinge 346.

It will be understood that the embodiments described herein are merely exemplary and that a person skilled in the art may make many variations and modifications without departing from the spirit and scope of the present invention. For instance, the size of the slots can be altered or the angle of the slots could be rotated from the vertical, to allow for easy insertion of different blade styles (i.e., NEMA configurations 2-15P, 5-15P, 7-15P, 2-20P, or 2-30P). Thus, the same basic bridge design can be used in a variety of applications. All such variations and modifications are intended to be included within the scope of the present invention as defined in the appended claims.

What is claimed is:

1. A conductor bridge for holding a plurality of electrically conductive elements, comprising:

a monolithic body formed from electrically non-conductive material and having a plurality of slots for holding a corresponding plurality of electrically conductive elements in electrically insulated position relative to each other, said body having closure members hingedly attached thereto proximate to each of said slots, each of said closure members having an open position, in which a conductive element can be placed in a corresponding one of said slots, and a closed position, in which said closure member bridges said corresponding one of said slots for retaining a conductive element therein.

2. The conductor bridge of claim 1, wherein said conductive elements are conductor blades for a male electrical plug.

3. The conductor bridge of claim 2, wherein said conductor blades are two in number.

4. The conductor bridge of claim 1, wherein said bridge is a premold accommodating an overmolded layer of insulating material thereover to form a male electrical plug.

5. The conductor bridge of claim 1, wherein said bridge holds a pair of conductor blades and a ground pin of a male electrical plug.

6. The conductor bridge of claim 1, wherein each of said closure member has a catch disposed at a free end thereof, said catch cooperating with a mating latch disposed on said body to maintain said closure member in a bridging position.

7. The conductor bridge of claim 6, wherein corresponding contact surfaces on said closure member and said body contact one another when said closure member is in a bridging position, said corresponding contact surfaces including at least one tooth on a first of said contact surfaces and a mating notch on the other of said contact surfaces for preventing said contact surfaces from sliding relative to one another.

8. A conductor bridge for holding a plurality of electrically conductive elements, comprising:

a monolithic body formed from electrically non-conductive material and having a plurality of retainers for retaining a plurality of electrically conductive elements such that they are insulated relative to each other, each of said plurality of retainers having an open position, in which conductor elements can be placed therein, and a closed postition, in which conductor elements can be held in place within said body, each of said plurality of retainers including an L-shaped arm projecting from a central portion of said body and defining an open-ended slot for accommodating an associated conductor element; and a closure member hingedly connected to said L-shaped arm proximate said open end of said slot, said closure member being movable between a first position, which corresponds to said open position of said retainer and in which said closure member is parallel to said open-ended slot, and a second position, which corresponds to said closed position of said retainer and in which said closure member is perpendicular to said open-ended slot, said closure member bridging between said L-shaped arm and said central portion of said body to thereby close said open-ended slot when said closure member is in its said second position.

9. The conductor bridge of claim 8, wherein each closure member interlocks with said central portion of said body to hold said closure member in its said second position.

10. The conductor bridge of claim 9, wherein each closure member has a catch disposed at a free end thereof, said catch cooperating with a mating latch disposed on said central portion of said body to hold said closure member in its said second position.

11. The conductor bridge of claim 10, wherein each closure member has at least one tooth disposed proximate to said free end thereof, said tooth cooperating with a mating notch disposed on said central portion of said body to restrain said free end of said closure member from moving in a direction perpendicular to the direction of closure of said closure member when in its said second position.

12. A conductor bridge for holding a plurality of electrically conductive elements, comprising:

a monolithic body formed from electrically non-conductive material and having a plurality of retainers for retaining a plurality of electrically conductive elements such that they are insulated relative to each other, each of said plurality of retainers having an open position, in which conductor elements can be placed therein, and a closed position, in which conductor elements can be held in place within said body, each of said retainers extending at about 90 degrees relative to a central portion of said body when it said open position and folding approximately 90 degrees relative to said open position to form a slot for receiving a conductor element prior to assuming said closed position.

13. The conductor bridge of claim 12, wherein each of said retainers has a pair of fold lines spaced along the length thereof and dividing said retainer into three portions, an inner portion extending at about 90 degrees from said central portion of said body to a first fold line of said pair, a middle portion extending from said first fold line to a second fold line of said pair, and an outer portion extending from said second fold line to a free end of said retainer, said first fold line permitting said retainer to be folded so as to define a slot between said middle portion of said retainer and said central portion of said body, and said second fold line permitting said outer portion of said retainer to be folded such that said retainer assumes its said closed position.

14. The conductor bridge of claim 13, wherein said outer portion interlocks with said central portion of said body to hold said retainer in its said closed position.

15. The conductor bridge of claim 14, wherein said outer portion has a catch disposed at said free end, said catch cooperating with a mating latch disposed on said central portion of said body to hold said retainer in its said closed position.

16. The conductor bridge of claim 15, wherein said outer portion has at least one tooth disposed proximate to said free end, said tooth cooperating with a mating notch disposed on said central portion of said body to restrain said free end from moving in a direction perpendicular to the direction of closure of said outer portion when said retainer is in its said closed position.

17. The conductor bridge of claim 12, wherein each of said retainers has a fold line dividing said retainer into two portions, an inner portion extending at about 90 degrees from said central portion of said body to said fold line and an outer portion extending from said fold line to a free end of said retainer, said fold line facilitating the transition of said retainer from said open position to said closed position and permitting said retainer to define a slot between said retainer and said central portion of said body, said central portion having an overhang projecting therefrom parallel to said inner portion, said overhang interlocking with said outer portion to retain a conductor element within said slot.

18. The conductor bridge of claim 17, wherein said outer portion has a catch disposed at said free end, said catch cooperating with a mating latch disposed on said overhang to hold said retainer in its said closed position.

19. The conductor bridge of claim 18, wherein said outer portion has at least one tooth disposed proximate to said free end, said tooth cooperating with a mating notch disposed on said overhang to restrain said free end from moving in a direction perpendicular to the direction of closure of said outer portion when said retainer is in its said closed position.

20. A conductor bridge, comprising:

a body;

a first arm integrally molded to said body;

a second arm integrally molded to said body;

a first slot located between said first arm and said body, said first slot having an open end and being sized and shaped to receive a portion of a first electrical plug blade;

a second slot located between said second arm and said body, said second slot having an open end and being sized and shaped to receive a portion of a second electrical plug blade;

a first closure member hingedly connected to and integrally molded with said first arm; and a second closure member hingedly connected to and integrally molded with said second arm, said first and second closure members each having an open position in which said first and second plug blades, respectively, can be placed in said first and second slots, respectively, said first and second closure members bridging said first and second slots, respectively, when in a closed position to retain said first and second plug blades within said first and second slots, respectively.

21. The conductor bridge of claim 20, wherein each of said first and said second closure members includes means for preventing the respective movement of said first and said second closure members relative to said body.

* * * * *